US006298485B1

(12) United States Patent
Heller

(10) Patent No.: US 6,298,485 B1
(45) Date of Patent: Oct. 9, 2001

(54) INTERCHANGEABLE THREE IN ONE CYCLING JERSEY WITH HIDDEN ZIPPERS

(75) Inventor: Michael D. Heller, Boulder, CO (US)

(73) Assignee: Interchange Sport, Inc, Boulder, CO (US)

( * ) Notice: Subject to any disclaimer, the term of this patent is extended or adjusted under 35 U.S.C. 154(b) by 0 days.

(21) Appl. No.: 09/544,106

(22) Filed: Apr. 6, 2000

(51) Int. Cl.[7] ..... A41B 1/08; A41D 27/10
(52) U.S. Cl. ..... 2/70; 2/126; 2/93
(58) Field of Search ..... 2/70, 85, 86, 90, 2/95, 93, 102, 126, 269, 69; D2/829, 830

(56) References Cited

U.S. PATENT DOCUMENTS 1,147,155 * 7/1915 Farlow .
1,489,046 * 4/1924 Thompson .
1,505,053 * 8/1924 Millhauser .
2,099,431 * 11/1937 Reeb ..... 2/126
2,147,054 * 2/1939 Pearson ..... 2/125
2,313,519 * 3/1943 Cuttler ..... 2/97
2,677,131 * 5/1954 Shuster ..... 2/126
4,006,495 * 2/1977 Jones ..... 2/93
4,068,316 * 1/1978 Haywood ..... 2/126
4,122,553 * 10/1978 Pitkanen ..... 2/102
4,302,850 * 12/1981 Maeshima ..... 2/102
4,320,538 * 3/1982 Saft ..... 2/102
4,347,629 * 9/1982 Itoi ..... 2/108
4,554,682 * 11/1985 Hillquist ..... 2/70
4,999,850 * 3/1991 Grilliot et al. ..... 2/126
5,628,064 * 5/1997 Chung ..... 2/70
5,673,836 * 10/1997 Bush ..... 224/576
5,717,999 * 2/1998 Lurry ..... 2/69
5,918,315 * 7/1999 Trachtenberg ..... 2/125
6,047,404 * 4/2000 Blanks, I ..... 2/69

* cited by examiner

*Primary Examiner*—John J. Calvert
*Assistant Examiner*—Alissa L. Hoey
(74) *Attorney, Agent, or Firm*—Edwin H. Crabtree; Ramon L. Pizarro; Donald W. Margolis

(57) ABSTRACT

An interchangeable three in one cycling jersey for providing a cyclist with a jersey vest, a vest with short sleeves and a vest with long sleeves. The cycling jersey allows the cyclist to quickly and conveniently convert the jersey vest using a pair of hidden sleeve zippers to a short sleeve or a long sleeve jersey. The jersey includes a jersey vest with a pair of attachable short sleeves and a pair of attachable long sleeves. The short and long sleeves include upper and lower arm openings for receiving the cyclist's arm therethrough. The jersey vest includes a front portion, a rear portion, a first side with a first arm opening, a second side with a second arm opening, an open bottom portion for putting on the jersey, a top portion with head opening and a collar therearound. The jersey vest is characterized by having one half of a narrow nylon hidden sleeve zipper attached to and disposed around a side of the first and second arm opening. The other half of the zipper is attached to and disposed around a side of either the upper arm opening in the short sleeves or the upper arm opening in the long sleeves. The two sleeve zippers have a first and a second end mounted next to each other on the rear portion of the jersey vest. In this manner, a zipper handle and a zipper teeth connector are hidden when viewing the front of the jersey.

8 Claims, 1 Drawing Sheet

INTERCHANGEABLE THREE IN ONE CYCLING JERSEY WITH HIDDEN ZIPPERS

BACKGROUND OF THE INVENTION (a). Field of the Invention

This invention relates to jerseys used in biking and related sports and more particularly, but not by way of limitation, to a cycling jersey having a jersey vest with interchangeable short and long sleeves. The sleeves are connected to the jersey vest using a pair of narrow hidden sleeve zippers.

(b). Discussion of Prior Art

In U.S. Pat. No. 4,122,553 to Pitkanen and U.S. Pat. No. 4,068,316 to Clancey, a convertible jacket and vest and a convertible shirt are disclosed having zippers for removing sleeves from the garment. In U.S. Pat. No. 5,673,836 to Bush, a modular outdoor vest with removable sleeves is illustrated. In U.S. Pat. No. 5,717,999 to Lurry and U.S. Pat. No. 4,320,538 to Saft, two different types of modular clothing and wearing apparel are described having insulated vests with removable sleeves. In U.S. Pat. No. 5,584,737 to Luhtala, a flotation jacket is described with a buoyant vest and jacket sleeves with zippers.

While the above mentioned patents illustrate different types of jackets and vests with removable sleeves using zippers, none of these patents specifically disclose the unique features and function, objects and advantages of the subject three in one interchangeable cycling jersey with hidden sleeve zippers as described herein.

SUMMARY OF THE INVENTION

In view of the foregoing, it is a primary object of the subject invention to provide cyclists and other outdoor enthusiasts with a unique interchangeable three in one jersey with a jersey vest and the vest with short sleeves or the vest with long sleeves.

Another object of the cycling jersey is the jersey allows the cyclist to quickly and conveniently convert the jersey vest using a pair of hidden sleeve zippers to either a short sleeve or a long sleeve jersey depending on the outdoor temperature, weather conditions, riding conditions and the desired comfort of the wearer of the jersey.

Still another object of the invention is the jersey vest and the short and long sleeves include narrow nylon plastic hidden sleeve zippers for attaching either the short or long sleeves to the sides of arm openings in opposite sides of the vest wherein the hidden zippers give an outward appearance of "racing stripes" or "piping" for an enhanced streamlined aesthetic look. The sleeve zippers may be of different colors for providing an attractive contrast to the color of the jersey. For example the zippers may be one color while the vest and sleeves are a different color.

Yet another object of the jersey is the jersey vest and the short and long sleeves include enlarged arm openings to provide sufficient room under the arm pit area to prevent a portion of the hidden zipper contacting and rubbing against the under arms of the user.

A further object of the invention is the jersey may include cloth mesh along a length of sides of the jersey vest for increased ventilation and cooling when the jersey is in use. Also, a front portion of the jersey vest may include an opening with a front zipper for opening and closing the front of the vest.

The three in one jersey includes a jersey vest with a pair of attachable short sleeves and a pair of attachable long sleeves. The short and long sleeves include upper arm openings and lower arm openings for receiving the cyclist's arm therethrough. The jersey vest includes a front portion with an opening with a front zipper, a rear portion, a first side with an enlarged first arm opening, a second side with an enlarged second arm opening, an open bottom portion for putting on the jersey and a top portion with head opening and a collar therearound.

The jersey vest is characterized by having one half of a narrow nylon hidden sleeve zipper with zipper teeth attached to and disposed around a side of the first and second arm opening. The other half of the hidden sleeve zipper with zipper teeth is attached to and disposed around a side of either the upper arm opening in the short sleeves or the upper arm opening in the long sleeves. The two sleeve zippers have a first end and a second end next to each other and next to the rear portion of the jersey vest. In this manner, a zipper handle and a zipper teeth connector are hidden when viewing the front of the jersey.

These and other objects of the present invention will become apparent to those familiar with different types of outdoor shirts and jerseys when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
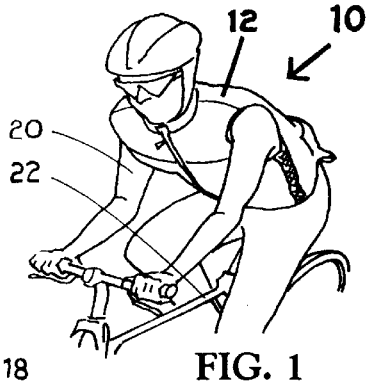
FIG. 1 is a perspective view of a cyclist on his or her bicycle and wearing the subject jersey. In this example, the cyclist is wearing the jersey vest without either the interchangeable short or long sleeves.

In FIG. 1, a perspective view of the subject interchangeable three in one cycling jersey is shown and having a general reference numeral 10. The cycling jersey 10 broadly includes a jersey vest 12, a pair of short sleeves 14, a pair of long sleeves 16 and a pair of narrow plastic hidden sleeve zippers 18. The sleeves 14 and 16 and the zippers 18 are shown in FIGS. 2–4.

In this drawing, the jersey vest 12 is shown being worn by a cyclist 20 riding a bicycle 22. While the subject jersey 10 is mentioned being associated with bike riding, it can be appreciated the jersey can be used in other types of outdoor activities equally well.

Figure 2:
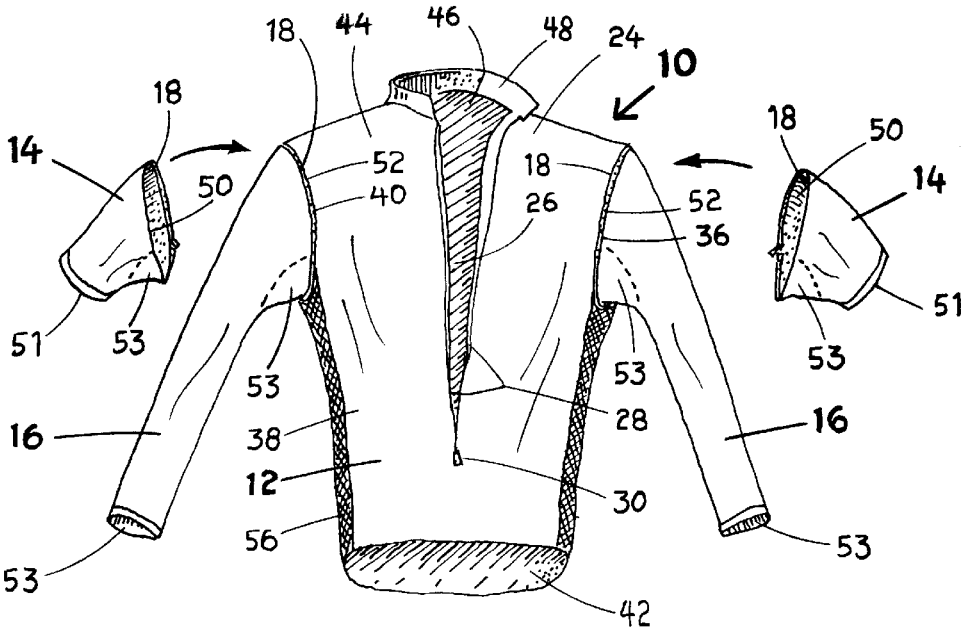
FIG. 2 is a front view of the subject cycling jersey with long sleeves attached to the jersey vest. Also, short sleeves are shown positioned for attachment to the jersey vest when the long sleeves are removed.

In FIG. 2, the jersey vest 12 includes a front portion 24 with a vertical front opening 26. The front opening 26 can be opened and closed using a front zipper 28 with a zipper handle 30. Obviously, the front opening 26 helps in taking the jersey 10 "on" and "off" and allows for keeping warm by closing the opening 26 or cooling the cyclist 20 by unzipping the zipper 28.

Figure 3:
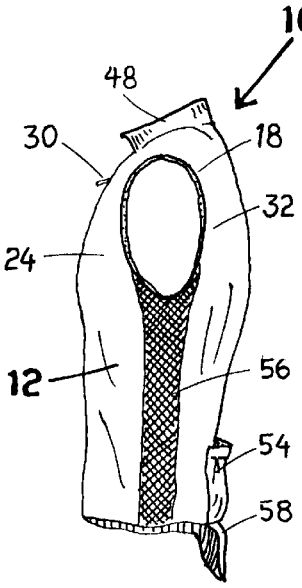
FIG. 3 is a side view of the jersey vest with pockets formed in the bottom of a rear portion of the vest.
Figure 4:
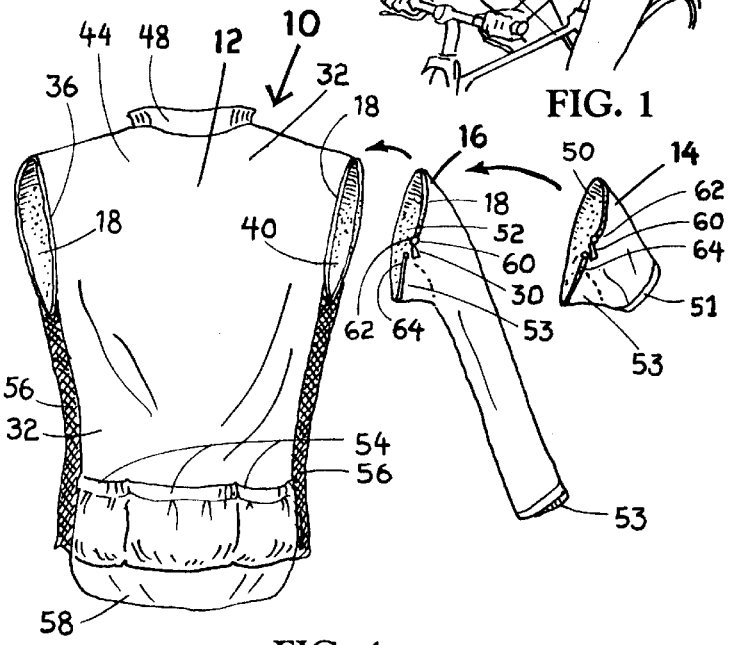
FIG. 4 is a rear view of the jersey vest with one of the long sleeves an one of the short sleeves positioned for attaching around the side of an arm opening in the vest.

The vest 12 also includes a rear portion 32, which is shown in FIGS. 3 and 4, a first side 34 with an enlarged first arm opening 36, a second side 38 with an enlarged second arm opening 40, an open bottom portion 42 for putting on the jersey 10 and a top portion 44 with head opening 46 and a collar 48 therearound.

The jersey vest 12 is characterized by having one half of a sleeve zipper 18 with zipper teeth attached to and disposed around a side of the first and second arm openings 36 and 40. The other half of the sleeve zipper 18 with zipper teeth is attached to and disposed around a side of either an enlarged upper arm opening 50 in the short sleeves 14 or an enlarged upper arm opening 52 in the long sleeves 16. The short sleeves 14 and the long sleeves 16 also include lower arm openings 51 and 53 for receiving the cyclist's arms therethrough.

In this drawing, the long sleeves 16 are attached to the sides of the first and second arm openings 36 and 40 using the sleeve zippers 18. Note, because the sleeve zippers 18 are narrow in construction and hemmed around the arm openings, the zippers 18 give a viewer the appearance of "racing strips" or "piping" for a more distinctive flair. Also, another important feature of the nylon plastic zippers 18 is the their color. The zippers 18 may be made of one color, for example "white or black", and the vest 12 and sleeves 14 and 16 made of a contrasting color, such as "blue".

Also, the short sleeves 14 and the long sleeves 16 includes and enlarged underarm area 53. This enlarged underarm area 53 to correspond with the enlarged first and second arm openings 36 and 40. This enlargement of the underarm area helps insures that when either the short sleeves 14 or the long sleeves 16 are attached to the jersey vest 12 using the sleeve zippers 18, the zippers do not contact the underarm area of the cyclist 20 and rub thereagainst.

In FIG. 3, a side view of the jersey vest 12 is shown. In this drawing, pockets 54 are shown formed at the bottom of the rear portion 32 of the vest 12. The pockets 54 can be used for holding one or more water bottles, the short and long sleeves 14 and 18 when not attached to the vest 12 and other items. The first side 34 and second side 38 may also include a cloth mesh 56 for added cooling and appearance. The jersey 10 may also include a shirt tail 58 extending downwardly from the rear portion 32. The shirt tail 58 helping to keep the jersey 10 tucked in during cycle riding.

In FIG. 4, a rear view of the jersey vest 12 is illustrated with one of the long sleeves 16 and one of the short sleeves 14 positioned for attaching around the side of the enlarged second arm opening 40 in the vest 12.

The two sleeve zippers 18 each have a zipper handle 30 with teeth connector 60. The teeth connector 60 is used for attaching and unattaching the zipper teeth around the side of the upper arm openings 50 or 52 of the sleeves 14 and 16 to the zipper teeth around the side of the first and second arm openings 36 and 40 of the vest 12. A first end 62 of the zipper 18 starts on the rear portion 32 of the vest 12 with the zipper extending around the arm openings and terminating with a second end 64 of the zipper disposed next to the first end 62. In this manner, when the zippers 18 are used for attaching either the short sleeves 14 or the long sleeves 16 to the sides of the arm openings 36 and 40, the opposite ends or the first and second ends 62 and 64 are positioned at the rear portion 32 of the jersey vest 12. The other half of the zippers 18 on the side of the first and second arm openings 36 and 40 of the vest 12 also start and end on the rear portion 32 of the jersey vest 12. This feature provides for keeping the zipper handle 30 and teeth connector 60 out of sight from the front of the jersey 10 when either the short or long sleeves 14 and 16 are attached to the vest 12.

While the invention has been shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. An interchangeable cycling jersey for a cyclist and others during outdoor activities, the jersey comprising:

a jersey vest having a first color, said jersey vest having a front portion, a rear portion, a first side with an enlarged first arm opening, a second side with an enlarged second arm opening, an open bottom portion for putting on the jersey and a top portion with head opening;

a pair of sleeve zipper search having a second color having a first half and a second half, the first half of each of said sleeve zippers attached to and disposed around a side of the enlarged first and second arm openings of said jersey vest; and a pair of sleeves having the first color, said sleeves include enlarged upper arm openings and lower arm openings adapted for receiving the cyclist's arm therethrough, the second half of each of said sleeve zippers attached to and disposed around a side the enlarged upper arm opening in said sleeves, the second half of said sleeve zipper releasably attached to the first half of said sleeve zipper disposed around the side of the enlarged first and second arm openings of said jersey vest;

whereby said sleeve zipper, when connecting said sleeves to said jersey vest, providing a racing stripe or piping around the side of the enlarged first and second arm openings for an enhanced streamlined aesthetic look, the first color of said sleeves and said jersey vest and the second color of said sleeve zipper providing a contrast when viewing the cycling jersey.

2. The jersey as described in claim 1 wherein each of said sleeve zippers includes a first end and a second end, the first end and second end of said zipper starting and ending on the rear portion of said jersey vest when said sleeves are attached to said jersey vest.

3. The jersey as described in claim 1 wherein said sleeves have an enlarged underarm area so that when each of said sleeve zippers connects said sleeves to said jersey vest, sufficient room is provided to prevent a portion of said sleeve zipper from rubbing against an underarm area of the cyclist.

4. An interchangeable cycling jersey for a cyclist and others during outdoor activities, the jersey comprising:

a jersey vest having a first color, said jersey vest having a front portion, a rear portion, a first side with an enlarged first arm opening, a second side with an enlarged second arm opening, an open bottom portion for putting on the jersey and a top portion with head opening;

a pair of sleeve zippers having a second color, each of said sleeve zippers having a first half and a second half, the first half of each of said sleeve zippers attached to and disposed around a side of the enlarged first and second arm openings of said jersey vest;

a pair of short sleeves having the first color, said short sleeves include enlarged upper arm openings and lower arm openings adapted for receiving the cyclist's arm therethrough, the second half of each of said sleeve zippers is attached to and disposed around a side of the enlarged upper arm openings in said short sleeves, the second half of each of said sleeve zippers releasably attached to the first half of each of said sleeve zippers disposed around the side of the enlarged first and second arm openings of said jersey vest; and a pair of long sleeves having the first color, said long sleeves include enlarged upper arm openings and lower arm openings adapted for receiving the cyclist's arm therethrough, another second half of each of said sleeve zippers is attached to and disposed around a side of the enlarged upper arm openings in said long sleeves, the another second half of each of said sleeve zippers releasably attached to the first half of each of said sleeve zippers disposed around the side of the enlarged first and second arm openings of said jersey vest;

whereby each of said sleeve zippers when connecting said short and long sleeves to said jersey vest, providing a racing stripe or piping around the side of the enlarged first and second arm openings for an enhanced streamlined aesthetic look, the first color of said short and long sleeves and said jersey vest and the second color of each of said sleeve zippers providing a contrast when viewing the cycling jersey.

5. The jersey as described in claim 4 wherein each of said sleeve zippers includes a first end and a second end, the first end and second end of each of said zippers starting and ending on the rear portion of said jersey vest when either said short sleeves or said long sleeves are attached to said jersey vest.

6. The jersey as described in claim 4 wherein said short and long sleeves have an enlarged underarm area so that when each of said sleeve zippers connects said short or long sleeves to said jersey vest, sufficient room is provided to prevent a portion of said sleeve zippers from rubbing against an underarm area of the cyclist.

7. An interchangeable cycling jersey for a cyclist and others during outdoor activities, the jersey comprising:

a jersey vest having a first color, said jersey vest having a front portion, a rear portion, a first side with an enlarged first arm opening, a second side with an enlarged second arm opening, an open bottom portion for putting on the jersey and a top portion with head opening;

a each of sleeve zippers having a second color, each of said sleeve zippers having a first half and a second half, the first half of each of said sleeve zippers attached to and disposed around a side of the enlarged first and second arm openings of said jersey vest, each of said sleeve zippers includes a first end and a second end, the first end and second end of said zippers starting and ending on the rear portion of said jersey vest;

a pair of short sleeves having the first color, said short sleeves include enlarged upper arm openings and lower arm openings adapted for receiving the cyclist's arm therethrough, the second half of each of said sleeve zippers is attached to and disposed around a side of the enlarged upper arm openings in said short sleeves, the second half of each of said sleeve zippers releasably attached to the first half of said sleeve zipper disposed around the side of the enlarged first and second arm openings of said jersey vest; and a pair of long sleeves having the first color, said long sleeves include enlarged upper arm openings and lower arm openings adapted for receiving the cyclist's arm therethrough, another second half of each of said sleeve zippers is attached to and disposed around a side of the enlarged upper arm openings in said long sleeves, the another second half of each of said sleeve zippers releasably attached to the first half of each of said sleeve zippers disposed around the side of the enlarged first and second arm openings of said jersey vest;

whereby said sleeve zipper, when connecting said short and long sleeves to said jersey vest, providing a racing stripe or piping around the side of the enlarged first and second arm openings for an enhanced streamlined aesthetic look, the first color of said short and long sleeves and said jersey vest and the second color of said sleeve zippers providing a contrast when viewing the cycling jersey.

8. The jersey as described in claim 7 wherein said short and long sleeves have an enlarged underarm area so that when each of said sleeve zippers connects said short or long sleeves to said jersey vest, sufficient room is provided to prevent a portion of said sleeve zippers from rubbing against an underarm area of the cyclist.

* * * * *